US006666678B2

(12) United States Patent
Sung

(10) Patent No.: US 6,666,678 B2
(45) Date of Patent: Dec. 23, 2003

(54) MULTI-BUTTON PIEZOELECTRIC CHILD-RESISTANT CIGARETTE LIGHTER

(75) Inventor: Kil Young Sung, Fullerton, CA (US)

(73) Assignee: Calico Brands, Inc., Ontario, CA (US)

( * ) Notice: Subject to any disclaimer, the term of this patent is extended or adjusted under 35 U.S.C. 154(b) by 0 days.

(21) Appl. No.: 10/066,178

(22) Filed: Jan. 30, 2002

(65) Prior Publication Data

US 2002/0086256 A1 Jul. 4, 2002

Related U.S. Application Data

(63) Continuation-in-part of application No. 09/970,725, filed on Oct. 30, 2001, now Pat. No. 6,422,860, which is a continuation of application No. 09/629,027, filed on Jul. 31, 2000, now Pat. No. 6,299,434, which is a continuation of application No. 09/454,225, filed on Dec. 2, 1999, now Pat. No. 6,095,796.

(51) Int. Cl.[7] ..... F23D 11/36; F23Q 2/28
(52) U.S. Cl. ..... 431/153; 431/255
(58) Field of Search ..... 431/255, 153

(56) References Cited

U.S. PATENT DOCUMENTS

| | | | | |
|---|---|---|---|---|
| 3,749,286 A | | 7/1973 | Douglas | |
| 4,784,602 A | | 11/1988 | Nitta | |
| 4,904,180 A | | 2/1990 | Nitta | |
| 5,145,358 A | | 9/1992 | Shike et al. | |
| 5,310,336 A | | 5/1994 | Segawa | |
| 5,334,011 A | | 8/1994 | Frigiere | |
| 5,462,432 A | | 10/1995 | Kim | |
| 5,492,468 A | | 2/1996 | Cirami | |
| 5,538,417 A | | 7/1996 | Chan | |
| 5,829,963 A | * | 11/1998 | Ichikawa | 431/153 |
| 5,833,448 A | | 11/1998 | Doucet | |
| 5,839,892 A | * | 11/1998 | Hwang | 431/153 |
| 5,885,069 A | | 3/1999 | Rogelet | |
| 6,010,328 A | * | 1/2000 | Sung | 431/153 |
| 6,086,358 A | | 7/2000 | Potskhishvilli et al. | |
| 6,095,796 A | * | 8/2000 | Sung | 431/153 |
| 6,129,544 A | | 10/2000 | Chen | |
| 6,135,761 A | | 10/2000 | Chen | |
| 6,142,767 A | | 11/2000 | Chan | |
| 6,146,129 A | | 11/2000 | Li | |
| 6,206,689 B1 | | 3/2001 | Doucet | |
| 6,213,759 B1 | | 4/2001 | Sung | |
| 6,224,368 B1 | * | 5/2001 | Chung | 431/153 |
| 6,264,463 B1 | * | 7/2001 | Sung | 431/153 |
| 6,287,109 B1 | * | 9/2001 | Hirota | 431/153 |
| 6,299,434 B1 | * | 10/2001 | Sung | 431/153 |
| 6,422,860 B2 | * | 7/2002 | Sung | 431/153 |
| 6,435,859 B1 | * | 8/2002 | Jon | 431/153 |

FOREIGN PATENT DOCUMENTS

| | | | | |
|---|---|---|---|---|
| EP | 0285748 | | 10/1988 | |
| JP | 11-351572 | * | 12/1999 | |
| JP | 2001-141237 | * | 5/2001 | 431/153 |
| WO | WO 01/57443 | * | 8/2001 | |

* cited by examiner

*Primary Examiner*—Carl D. Price
(74) *Attorney, Agent, or Firm*—Trojan Law Offices

(57) ABSTRACT

A safety mechanism in a cigarette lighter that utilizes a multi-button system: a button and a button cover. The button has at least two elevations and is placed adjacent to the button cover. The button cover is coupled to one of the elevations of the button. A blocking element limits the downward movement of the button cover sufficiently to prevent activation of the piezo unit. To operate the lighter, the user must apply pressure to the button to operate release fuel and to operate the piezo unit to generate a spark.

2 Claims, 5 Drawing Sheets

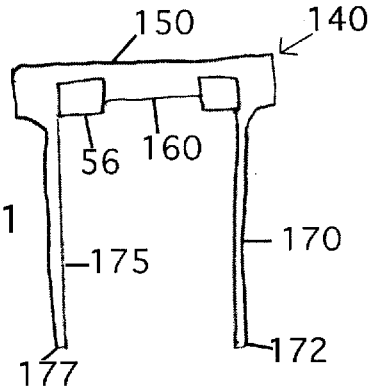
FIG. 11
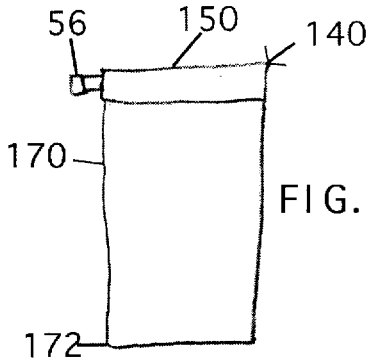
FIG. 12
FIG. 13
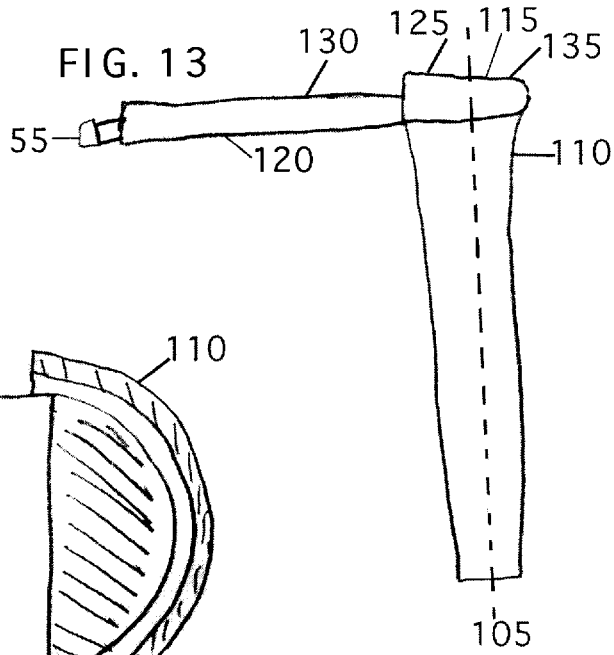
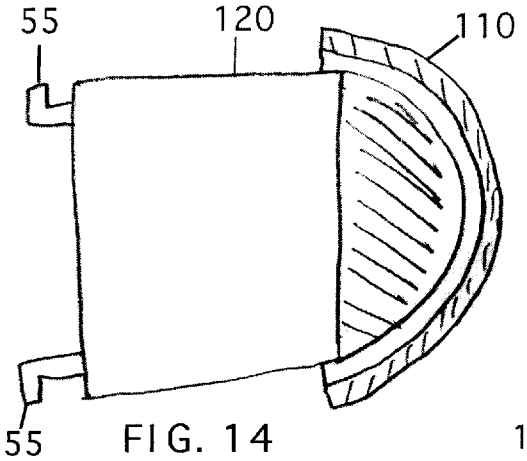
FIG. 14
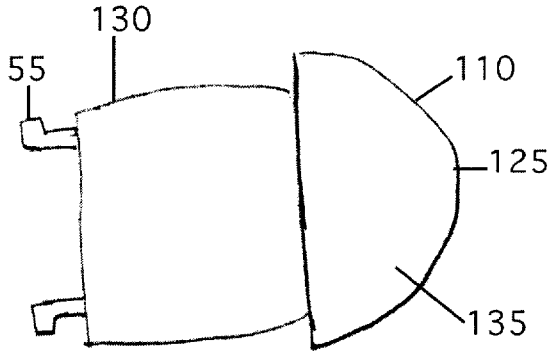
FIG. 15
FIG. 16
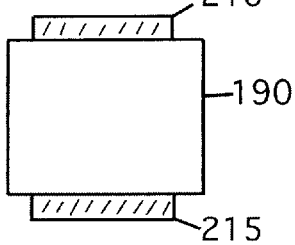

MULTI-BUTTON PIEZOELECTRIC CHILD-RESISTANT CIGARETTE LIGHTER

CLAIM OF PRIORITY

This application is a continuation-in-part of Ser. No. 09/970,725, filed Oct. 3, 2001, now U.S. Pat. No. 6,422,860, which is a continuation of Ser. No. 09/629,027, filed Jul. 31, 2000, now U.S. Pat No. 6,299,434, issued Oct. 9, 2001, which is a continuation of Ser. No. 09/454,225, filed Dec. 2, 1999, now U.S. Pat. No. 6,095,796, issued Aug. 1, 2000.

BACKGROUND OF INVENTION

1. Field of Invention

This invention relates generally to cigarette lighters having a child-resistant mechanism and more specifically to lighters employing a multi-button child-resistant mechanism.

2. Related Art

Cigarette lighters containing piezoelectric units are very useful and have become quite prevalent in modern times. Cigarette lighters of the type described herein generally contain a lighter housing that is small enough to be held in the palm of an adult hand. The operation of piezoelectric cigarette lighters is somewhat simpler than that of the traditional flint or spark-wheel lighter. Generally, the lighter is operated by depressing an actuator button, which both activate the piezoelectric unit and acts on a fuel-release lever to release fuel. As a result, a flame is produced at a location opposite the actuator button. As is evident, this process avoids the need for operation of a spark wheel simultaneously with operation of a fuel-release button in order to generate a flame. Obviously, there is an advantage to the simplicity that is offered by piezoelectric cigarette lighters. On the other hand, in the hands of children, or others who do not know how to safely and properly operate the lighter, such lighters are as dangerous as any other spark and/or flame-producing device. Thus, there is a need to equip cigarette lighters with safety features that minimize accidental or improper use by inexperienced persons, especially young children.

Many inventions have been created to address this safety-related concern. Generally, these inventions have sought to introduce safety mechanisms that disable operation of the actuator button of the lighter. As such, these lighters normally consist of a safety feature whereby the operational path of the actuator button is blocked by a latch, button, slide, or other blocking means. Proper operation of the lighter requires that the blocking means be moved out of the path of the actuator button, or another structure that might be integral with the actuator button, before a flame can be produced. Only then is the operator able to depress the actuator button and produce a flame. As such, the prior art requires additional structural members, as well as additional steps (e.g., lateral or longitudinal disengagement of a blocking means), to operate the lighter.

In some of the aforementioned cigarette lighters, the safety mechanism is passive. Once the safety feature is deactivated by moving the blocking member from the "locked" to the "unlocked" position, the lighter remains in the "unlocked" position, and the lighter is thus operable as a cigarette lighter with no safety feature at all. In these devices, the lighter remains in the "unlocked" position until the safety feature is activated again by manually re-engaging the safety mechanism (e.g., by manually returning the blocking means to the "locked" position).

In order to address this problem, some inventions have introduced safety mechanisms that are activated automatically after each use of the lighter. In general, this improvement has alleviated some of the fears associated with leaving the lighter in an "unlocked," operable position after the operator has finished using the lighter. Nevertheless, a disadvantage that is common to the passive, as well as the active, cigarette lighters is that their operation is usually quite cumbersome. Frequently, in order to use such cigarette lighters, the operator must use more than one finger, and sometimes more than one hand, to perform several functions simultaneously. As such, loss of ease of use is the price that is paid for any additional amount of safety that might be achieved.

Therefore, there is a need for a device that not only achieves the stated safety goals, but also is amenable to operation with relative ease. The invention described herein offers such a combination and consists of a safety button that is similar in size and physical location to the conventional activation button. The invention requires that an ignition button, located in a cavity within the safety button, be depressed simultaneously with the safety button before a flame can be produced. In another embodiment, a button cover is placed adjacent to an ignition button. In this way, young children are coaxed into believing that they can operate the lighter in the usual way, i.e., by pressing only the safety button. However, such operation will produce neither a spark nor a flame. Moreover, given the relatively small size of the ignition button, operation of this button requires an amount of strength and pulp that are rarely found in the fingers of young children. At the same time, due to the placement of the ignition button, simultaneous operation of both the safety button and the ignition button requires use of only one finger, so that operation of the lighter by the intended adult user is no different from operation of a lighter with no safety mechanism at all.

SUMMARY OF THE INVENTION

The primary object of this invention is to provide a safety mechanism for cigarette lighters so that children, or inexperienced users, will be less likely to inadvertently activate the lighter. Such a safety feature is especially important because young children often play with lighters as toys and because lighters have mechanically moveable parts that make them attractive to children as toys.

A second object of the present invention is to provide an improved device for maximizing safety in cigarette lighters without compromising ease of use.

The invention meets its objectives by providing an ignition button that must be depressed in order for a spark and a flame to be produced. The ignition button is placed within a cavity in the lighter's safety button, parallel to the lighter's longitudinal axis, with only a small portion of the ignition button (i.e., the ignition button's operation section) extending outside of the safety button's contact surface. Typically, a young child will attempt to activate the lighter by depressing the safety button only. However, when this is done, neither a spark nor a flame will be generated as the safety button is stopped along its path by a stopper before the spark-producing mechanism can be activated. The stopper is permanently attached to the inner surface of the lighter housing, so that it cannot be removed out of the safety button's path. As such, repeated operation of the safety button by a child will yield the same unsuccessful results.

The only way to activate the lighter is to depress the ignition button. When this is done, initially, the ignition button and the safety button will move towards the bottom end of the lighter in unison. However, when the stopper engages the safety button, the operator must continue to depress the ignition button until the spark-producing mechanism is activated. This is a simple, yet effective concept. Nevertheless, it is a concept that young children operating the lighter must recognize and grasp before they can successfully operate the lighter. In most cases, the child will not recognize the usefulness of the ignition button and will abandon the lighter after several unsuccessful attempts.

Moreover, even if a child does attain an appreciation for the interrelationship between the ignition button, the safety button, and the production of a flame, he/she will still have difficulty activating the lighter. The portion of the ignition button that is exposed (i.e., the ignition button operation section) is small relative to the size of the safety button. As such, it is more difficult to fully depress the ignition button than if the operator needed to depress only the larger, more-easily reachable, safety button. Thus, the single finger of a young child will not be able to fully depress the ignition button. Moreover, because of the smaller size and location of the ignition button, a child cannot use a plurality of fingers to try and depress the ignition button. As such, the strength needed to depress the ignition button, and the lack thereof in young children, itself acts as a deterrent in the present invention.

Furthermore, in order for the lighter to be successfully operated, the ignition button must be pressed in far enough so that the ignition button's operation section travels just past the safety button's contact surface. In order to achieve this task, the operator's finger must have enough pulp to depress the ignition button past the contact surface of the safety button. While an adult operator can easily perform this procedure, a child operator will have difficulty doing so. Hence, again, the structural configuration of the safety mechanism of the present invention acts as a deterrent to use by young children.

In another embodiment of the invention, there is a safety mechanism in a cigarette lighter that utilizes a multi-button system: a button and a button cover. The button has at least two elevations and is coupled with the button cover. The button cover is coupled to one of the elevations of the button. This embodiment also uses a blocking element, which limits the downward movement of the button cover sufficiently to prevent activation of the piezo unit. To operate the lighter, the user must continue to apply pressure to the button to release fuel and to operate the piezo unit to generate a spark to ignite said fuel.

Finally, as can be understood from the above description, the invention disclosed herein achieves its safety objectives without making operation of the lighter any more cumbersome than a conventional piezoelectric cigarette lighter with no safety feature. Specifically, the ignition button is shaped and positioned in such a way that operation of the lighter is very simple in experienced hands. An adult user familiar with the operation of cigarette lighters need use only one finger and activate the lighter as he/she would normally by placing the finger on the safety and ignition buttons. This allows the user to operate the lighter in a safe, yet non-complicated manner.

This and other advantages of the present invention will become more apparent through the following description of the drawings and detailed description of the preferred embodiment.

BRIEF DESCRIPTION OF THE DRAWINGS

FIG. 11 is frontal view of the button cover.

FIG. 12 is a side view of the button cover.

FIG. 13 is a side view of the button.

FIG. 14 is a bottom view of the button cover.

FIG. 15 is a top view of the button cover.

FIG. 16 is a top view of a cap with flanges.

DETAILED DESCRIPTION OF THE PREFERRED EMBODIMENT

Figure 3:
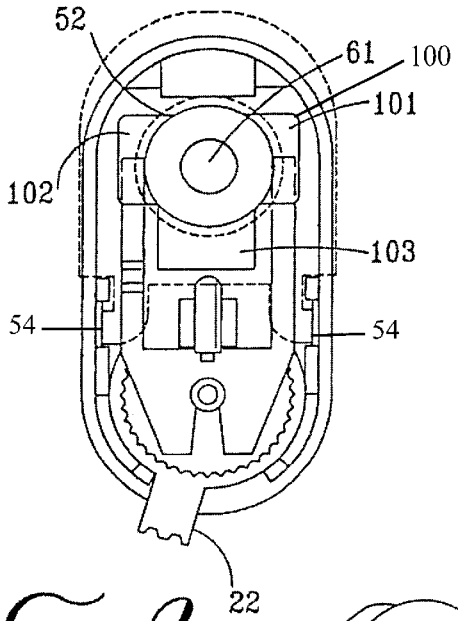
FIG. 3 a top view of the preferred embodiment with the outline of the safety button and without the windscreen.
Figure 1:
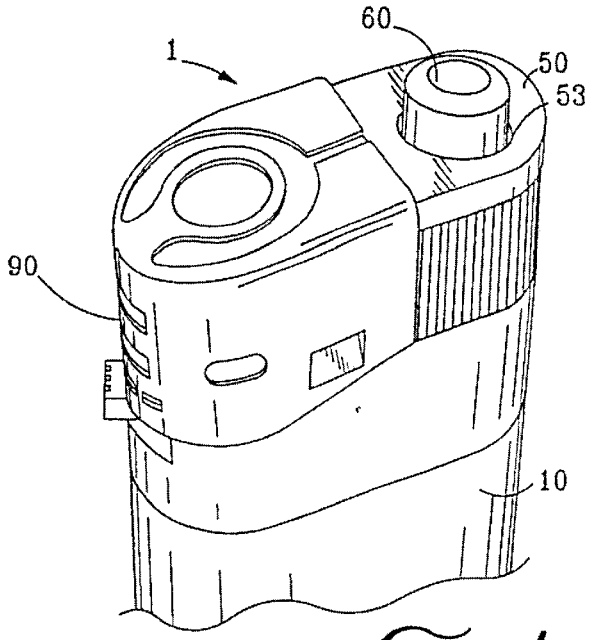
FIG. 1 is a perspective view of the preferred embodiment.
Figure 2:
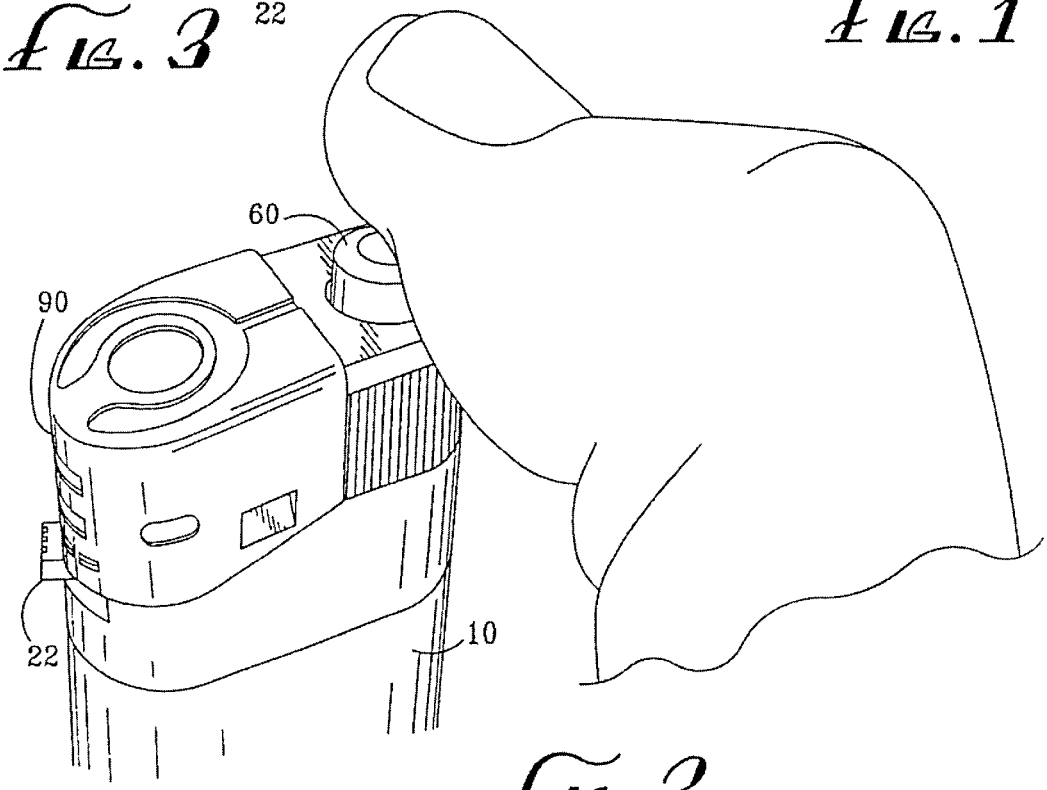
FIG. 2 a perspective view with a thumb operating the lighter.

A general description of the piezoelectric cigarette lighter (1) will be provided before presenting a detailed description of the safety feature that constitutes the invention.

The primary elements of the cigarette lighter (1) include a lighter housing (10), a fuel tank (20) which occupies the bottom portion of the lighter housing, a piezoelectric unit (30), an electric circuit connector (40), a safety button (50), an ignition button (60), a flange (100), a fuel-release lever (70) that translates the motion of the ignition button to open a fuel-discharge valve (21), a stopper (80) which acts to limit motion of the safety button, and a windscreen (90).

The lighter housing (10) of the lighter (1) has a cylindrical shape with an elliptical cross section, a bottom portion, and a top portion. A fuel tank (20) occupies substantially the bottom portion of the lighter housing (10) and contains conventional fuel, such as butane. Protruding from the topside of the fuel tank (20) is a fuel-discharge valve (21), which is spring-loaded, so that it is normally urged to the closed position. The valve is opened via the operation of a fuel-release lever (70). The lighter (1) is also equipped with a flame-adjusting wheel (22), which can be turned to adjust the amount of fuel released and thus, the height of the resultant flame.

The next element of the lighter (1) is a piezoelectric unit (30). This unit is fitted within the top portion of the fuel tank and protrudes from said top portion, opposite the fuel-discharge valve (21). The piezoelectric unit has a lower section, which constitutes the piezoelectric housing (31), and an upper section, which constitutes the sliding section (32). Operation of the piezoelectric unit (30) creates an electric discharge that is carried to the fuel-discharge valve

(21) via an electric circuit connector (40). The electric circuit connector (40) is generally made of material able to conduct electrical charge.

Another element of the lighter is the flange (100) that has an upper horizontal surface and two lower horizontal surfaces. The two lower horizontal surfaces (101 and 102) engage the fuel-release lever (70). The upper horizontal surface adjoins the ignition button and the safety button. The flange is located between the ignition button and the sliding section of the piezoelectric unit.

One of the primary elements of the child-resistant mechanism is the safety button (50). The safety button (50) is slidably mounted within the top portion of the lighter housing (10). The safety button (50) has integral guide arms (54) that allow the safety button to slide up and down along the longitudinal axis of, and relative to, the lighter housing (10). The safety button (50) has a contact surface (53), which has a generally flat surface, however, it is amenable to different degrees of curvature.

The next primary element is an ignition button (60). The ignition button (60) is slidably fitted within an aperture in the safety button (50) and has an operation section (61) that is exposed outside of the safety button contact surface (53). The ignition button (60) is of a generally round shape and is located above the sliding section of the piezoelectric unit.

The last primary element is the stopper (80). This is a projection that extends from the inner surface of the lighter housing (10), extending inward in a direction that is perpendicular to the longitudinal axis of the lighter (1). The stopper (80) functions by engaging and limiting the downward movement of the safety button (50).

Finally, the lighter (1) is equipped with a windscreen (90), which provides wind protection so that a flame is more easily generated, and less easily extinguished by wind. Moreover, the windscreen (90) holds the top portion of lighter (1) together by engaging the safety button (50) and the top portion of the lighter housing (10).

In the preferred embodiment, the primary elements of the safety-related invention described herein, as well as the interaction between these and the other, more conventional, elements of the cigarette lighter can be further defined as follows.

Figures 4A, 4B, 4C:
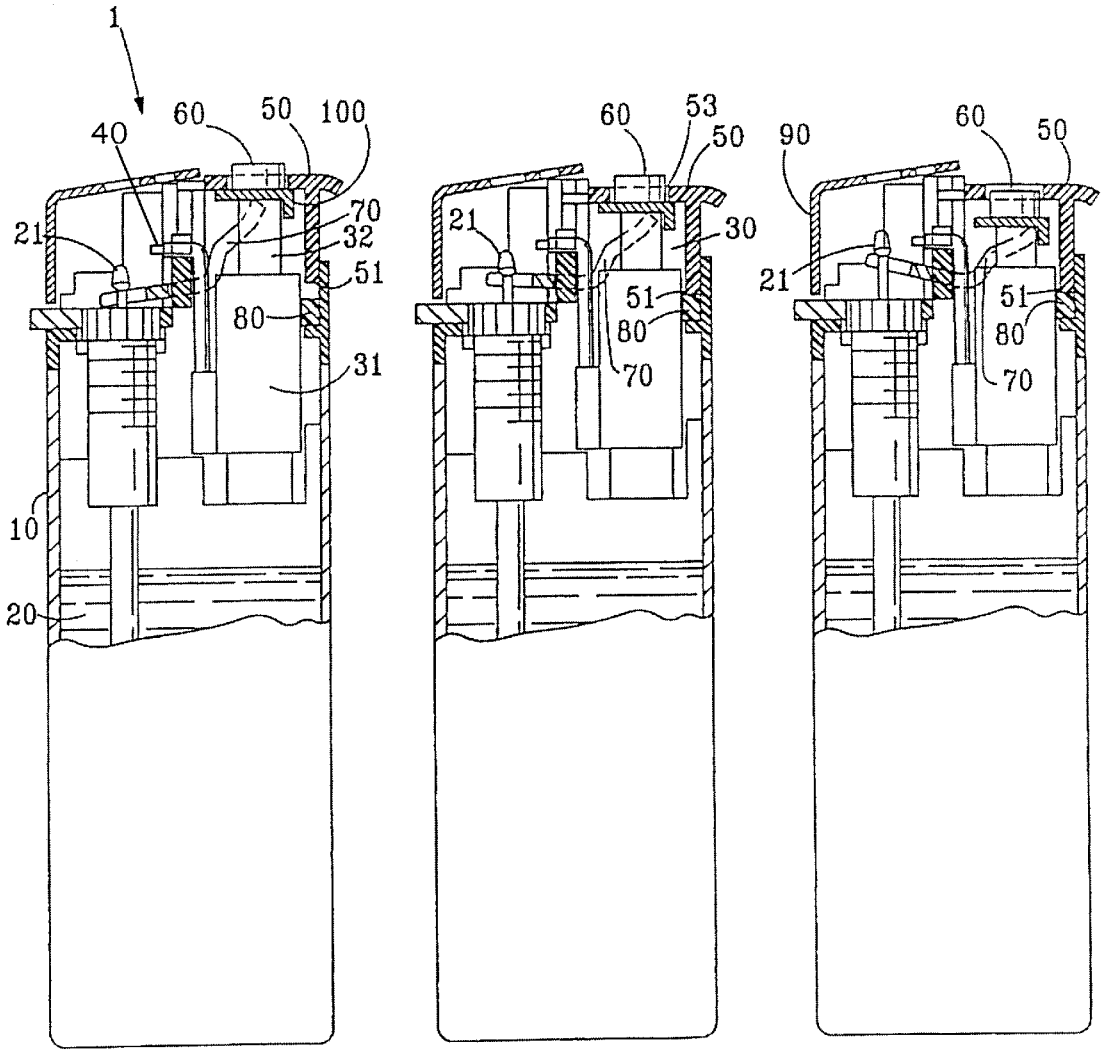
FIG. 4A is longitudinal cross-sectional view of the preferred embodiment.
FIG. 4B is the same view in the first stage of operation.
FIG. 4C is the same view in the second stage of operation.

In the preferred embodiment, the safety button (50) is slidably secured between the lighter housing (10) and the windscreen (90). The guide arms of the safety button allow the safety button to slide in a direction that is parallel to the longitudinal axis of the lighter (1). As shown in FIGS. 4A through 4C, the safety button (50) abuts the upper horizontal surface (103) of the flange (100). In this manner, whenever the safety button (50) is depressed, the flange and, thus, the sliding section (32) of the piezoelectric unit (30), also move in the same direction. Depressing the safety button results in activation of the fuel-discharge valve though the fuel-release lever.

Downward motion of the safety button (50) is limited, however, by the stopper (80). As shown in FIGS. 4A through 4C, the stopper (80) is a projection that extends inwardly from the inner surface of the lighter housing (10) and in a direction that is perpendicular to the longitudinal axis (105) of the lighter (1). In the preferred embodiment, the stopper (80) is positioned so that it engages the bottom edge (51) of the backside of the safety button (50) as the safety button is depressed.

But, the stopper may be positioned anywhere inside the lighter housing so long as it blocks downward movement of the safety button is blocked.

Activation of the piezoelectric unit (30) is achieved via operation of the ignition button (60). As shown in FIGS. 3 and 4, the ignition button (60) is slidably held within a space (52) defined parallel to the longitudinal axis (105) of the safety button (50) and has an operation section (61) that protrudes through the contact surface (53) of the safety button (50). The ignition button (60) is slidably held within a space (52) to permit parallel movement along the longitudinal axis (105) of the safety button (50). The ignition button (60) is fixedly attached to the top surface of the flange (100).

Although, in the diagrams depicting the preferred embodiment, the relative surface area of the operation section (61) of the ignition button (60) is shown to be approximately between one-third and one-half of that of the contact surface (53) of the safety button (50), this is not a requirement of the present invention. The smaller the cross-sectional area of the ignition button (60), the more difficult the operation of the lighter (1) for young children. As such, the relative sizes of the contact surface (53) and operation section (61) can be changed as dictated by safety requirements.

Also, in the preferred embodiment, the aperture (52) is located near the middle of the safety button (50). The invention described herein is not limited to this feature of the embodiment either. For example, the aperture (52) and the ignition button (60) can be located much closer to the windscreen (90). This would not diminish from the effectiveness of the safety feature for children or the ease of use of the lighter (1) for adult operators.

FIGS. 4A through 4C show the step-by-step operation of the preferred embodiment. The user operates the lighter (1) by depressing the operation section (61) of the ignition button (60). Initially, the ignition button (60) will move down slightly, until the surface of the operation section (61) of the ignition button (60) becomes parallel with the surface of the contact surface (53) of the safety button (50). As the user continues to apply downward pressure, both the ignition button (60) and the safety button (50) move in unison, until the stopper (80) engages the edge (51) of the safety button (50). As explained before, while this range of motion may be sufficient to open the fuel-discharge valve (21) via engagement of the fuel-release lever (70) by the flange (100), it is not enough to activate the piezoelectric unit (30). To achieve such activation, the user continues to depress the ignition button (60) below the contact surface (53) of the safety button (50). This requires that the user have sufficient pulp on his/her finger to push the operation section (61) of the ignition button (60) past the edge of, and inside, the aperture (52). This is a requirement that is generally not met in young children.

When the user releases the ignition button (60), the ignition button (60) returns to its original position by the urging force of a spring, which is located in the piezoelectric unit (30). Also, as the sliding section (32) of the piezoelectric unit (30) moves upwards, the upper horizontal section (103) of the flange pushes up on the safety button (50), thereby disengaging the edge (51) of the safety button (50) from the stopper (80) and returning the safety button (50) to its original position.

With reference to all the figures, it is noted that the invention disclosed herein is not to be limited by the embodiment shown in the figures and described in the description, which is provided by way of example and not of limitation, but only in accordance with the scope of the appended claims.

Another Embodiment

Figure 5:
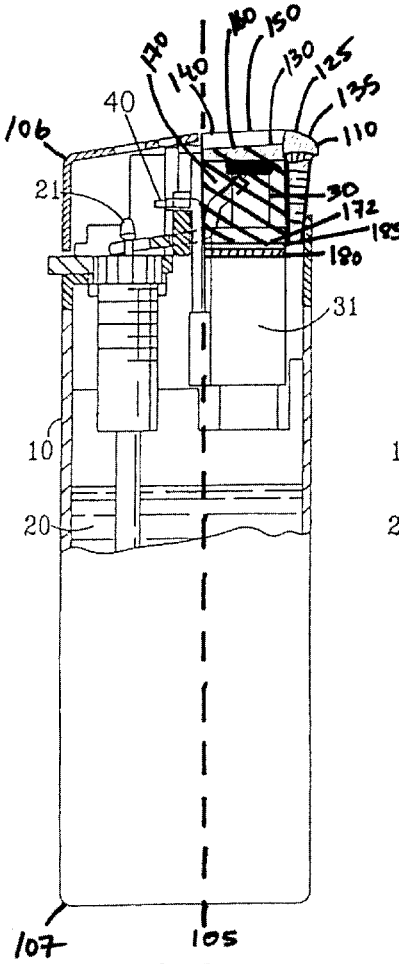
FIG. 5 is a side view of another embodiment of the invention using a button coupled to a button cover.
Figure 6:
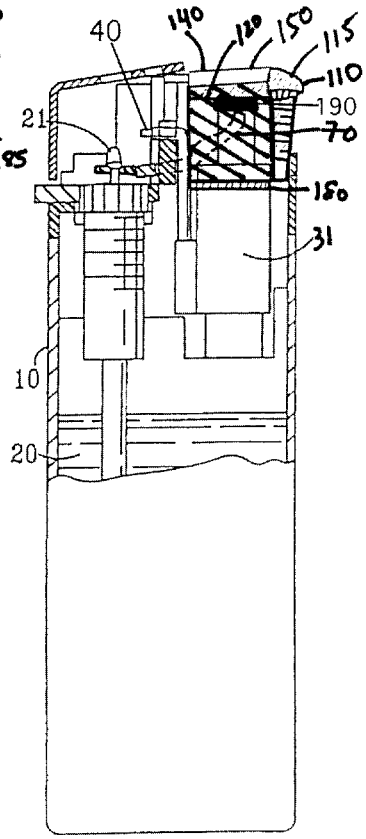
FIG. 6 is another side view of the embodiment in FIG. 5 when both the button cover and the button are depressed at the same time.
Figure 7:
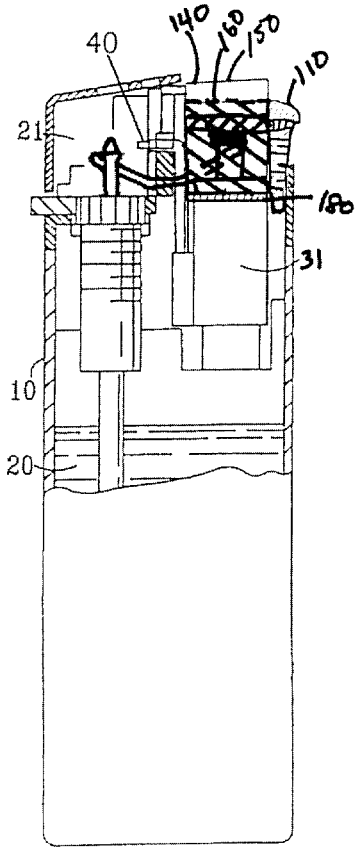
FIG. 7 is another side view of the embodiment in FIG. 5 when the button is depressed further than the button cover.
Figure 8:
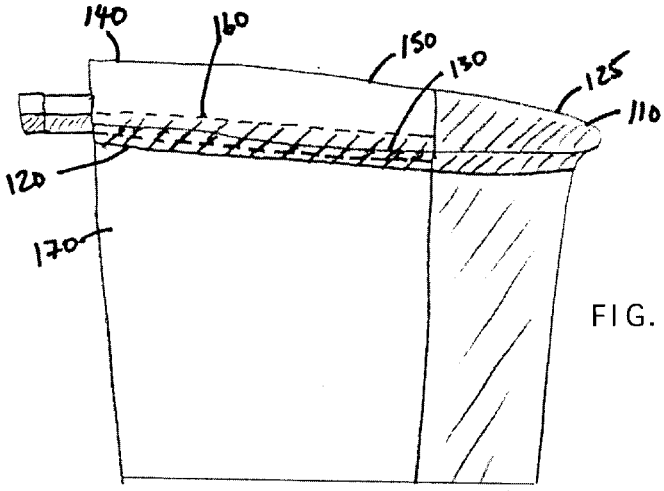
FIG. 8 is a side view of a button with a button cover.
Figures 9, 10:
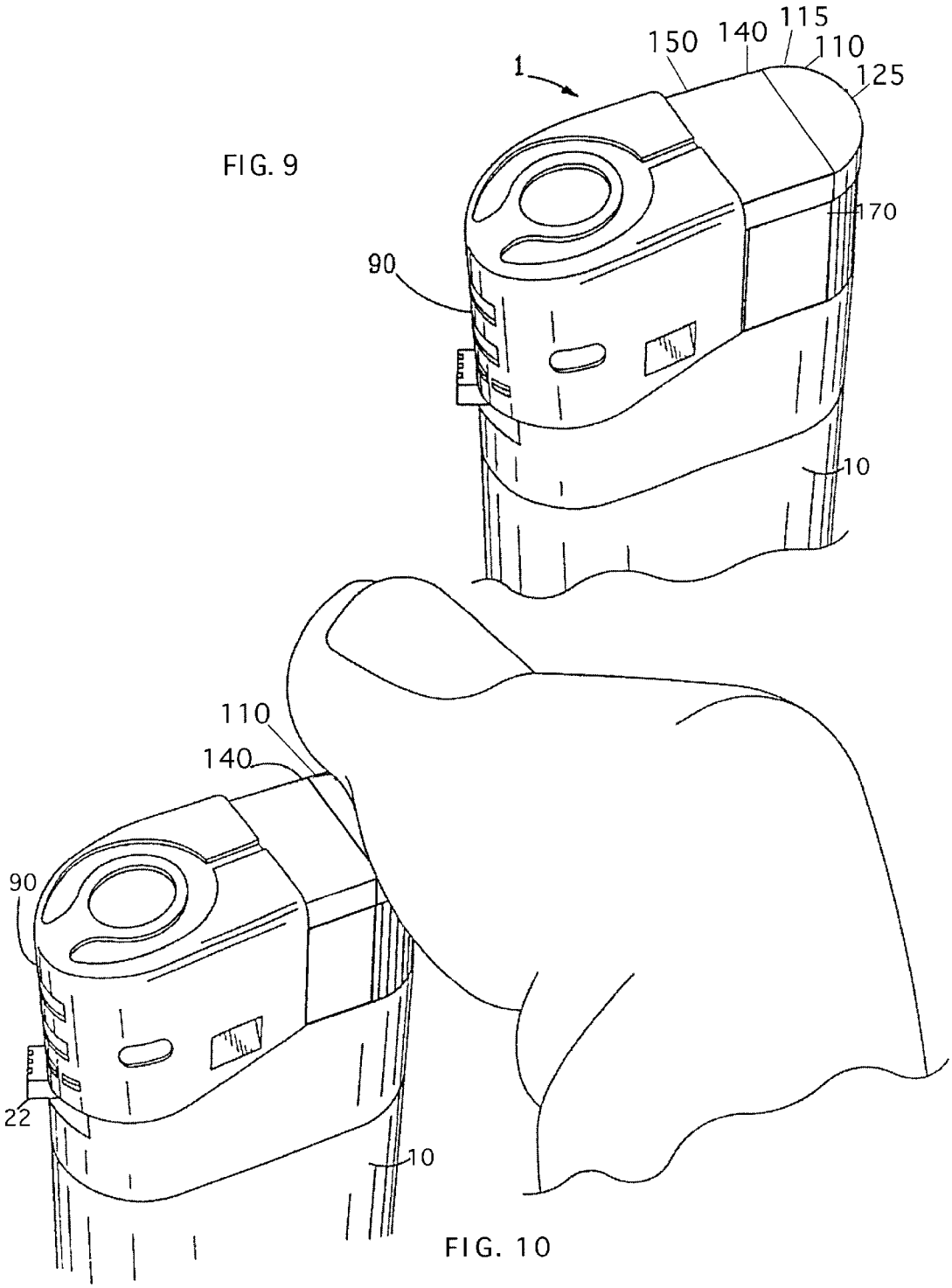
FIG. 9 is perspective view of the embodiment of FIG. 5.
FIG. 10 is a perspective view of the embodiment of FIG. 5 with a thumb operating the lighter.

As shown in FIGS. 5–16, there is another embodiment of the invention with the ignition button (110) slidably adjacent to a button cover (140). Similar to the embodiments above, FIGS. 5–7 show a lighter having a lighter housing or body (10) having a longitudinal axis (105), a fuel tank (20) is disposed within the body (10), a valve (21) for releasing fuel from said fuel tank (20), and a piezoelectric unit (30) capable of providing a spark to ignite fuel released from said tank (20).

In this embodiment, a button (110) activates the piezo unit (30) and releases fuel from the fuel release valve (21). This button (110) is slidably mounted within the top portion of the lighter housing (10) to allow the button (110) to slide up and down the longitudinal axis (105) of the lighter housing (10). This longitudinal axis (105) runs from the top (106) to the bottom (107) of the lighter (1).

As shown in FIGS. 13–15, the button can also have integral guide arms (55) to provide stability as the button (110) slides up and down. This button (110) has a top surface (115) and a bottom surface (120). The top surface (115) has a first elevation (125) and a second elevation (130), both of which are substantially perpendicular to the longitudinal axis (105) of the lighter body (10). The second elevation (130) of the button (110) extends over the piezo unit (30). The button (110) has a button activation surface (135), which is engaged by the user's thumb or finger.

There is also a button cover (140), which couples with the button (110). As shown in FIGS. 11–12, the button cover (140) has a first or contact surface (150) and a second or under surface (160). The button cover (140) can also have integral guide arms (56), which allow the button cover (140) to slide up and down the longitudinal axis (105) of, and relative to, the lighter housing (10) and to slide partially up and down with the button (110).

The under surface (160) of the button cover (140) extends over the second elevation (130) of the button, and the button cover (140) is capable of being substantially flush with the first elevation (125) of the button (110). The button cover (140) has sides (170, 175) that are substantially perpendicular to the under surface (160). In an alternative embodiment, instead of having integral guide arms (55, 56), both the button (110) and the button cover (140) can have notches or grooves on the edges that couple with the lighter housing (10) so that both the button (110) and the button cover (140) can be slidably mounted to the lighter housing (10).

The invention also incorporates a blocking element (180), which extends inward in a direction that is perpendicular to the longitudinal axis (105) of the lighter (1). In an alternative embodiment, this blocking element (180) can also extend from the inner surface of the lighter housing (10) or from the sides of the piezo unit (30). The blocking element (180) functions by engaging and limiting the downward movement of the button cover (140). At least one of the button cover sides (170, 175) is capable of engaging the blocking element (180) that prevents the button cover (140) from being depressed a sufficient distance to activate said piezo unit (30).

The blocking element (180) may be positioned anywhere inside the lighter housing so long as it blocks the downward movement of the button cover (140). For example, depending on the position of the parts, the blocking element (180) and the bottom edge (172, 177) of the button cover side (170, 175) form a space (185) when the user is not engaging the lighter. When the user applies downward pressure on the button cover (140), the button cover (140) travels through the space (185) to make contact with the blocking element (180). The blocking element (180) can be any size or shape as long as it engages and limits the downward movement of the button cover (140).

The first elevation (125) of the button (110) is capable of being depressed independently of said button cover (140) thereby causing the second elevation (130) to activate said piezo unit (30) and the valve (21) whereby a flame is generated.

For the user's finger or thumb, the button (110) has a button activation surface (135), which has a generally flat surface; however, it is amenable to different degrees of curvature, shapes or depressions. This button activation surface (135) can also have a variety of different surface textures as well. In FIGS. 5–10, the relative surface area of the button activation surface (135) is shown to be approximately between one-third and one-half of that of the button cover's contact surface (150), this is not a requirement of the present invention. The smaller the cross-sectional area of the button activation surface (135), the more difficult the operation of the lighter (1) for young children. As such, the relative sizes of the button activation surface (135) and button cover's contact surface (150) can be changed as dictated by safety requirements.

The user operates the lighter (1) by depressing the button activation surface (135) of the button (110). If the user contacts both the button activation surface (135) and the button cover's contact surface (150), initially, both the button cover (140) and the button (110) move in unison, until the blocking element (180) engages the button cover (140). While this range of motion for both the button cover (140) and the button (110) may be sufficient to partially open the fuel-discharge valve (21) via engagement of the fuel-release lever (70), it is not enough to activate the piezoelectric unit (30). To achieve such activation of the piezo unit (30), the user continues to depress the first elevation (125) of the button (110), even though the downward movement of the button cover (140) has stopped. By continuing to apply pressure to the button (110), the user will fully engage the fuel-release lever (70) to open the fuel-discharge valve (21) and also activate the piezoelectric unit (30) to generate a spark to ignite the released fuel and to create a flame. This requires that the user have sufficient pulp on his/her finger to push the button activation surface (135) below the point where the downward movement of the button cover (140) has stopped. This is a requirement that is rarely met in young children. The child is also fooled into thinking that the button has been depressed as far as it will go when the button cover (140) engages the blocking element (180).

When the user releases the button (110), both the button (110) and the button cover (140) return to their original positions by the urging force of a spring, which is located in the piezoelectric or piezo unit (30).

Activation of the piezo unit (30) is achieved via operation of the button (110). In an alternative embodiment, the button (110) also contacts a cap (190) that covers the top (200) of the piezo unit (30). As shown in FIG. 16, this cap (190) can also have flanges or wings (210, 215), which extend substantially perpendicularly from the longitudinal axis (105) of the lighter housing (10) or forms less than a ninety-degree angle with the longitudinal axis (105). When enough pressure is applied to the button (110), these flanges or wings (210, 215) contact the fuel release lever (70) to release fuel.

Additionally, instead of a separate cap (190), the bottom surface (120) of the button (110) can have flanges or extensions that will couple or saddle the top (200) of the piezo unit and contact the fuel-release lever (70). These flanges or extensions can be integral to the bottom (120) of the button.

Also, depending on the size, length, or placement of the following parts: blocking element (180), the button cover's sides (170, 175), the button cover (140), the button (110), and the fuel-release lever (70), it may be possible for the user to release some fuel when the button cover (140) is pressed down, but regardless of the position, size or length of the above parts as described above, the blocking element (180) prevents the button cover (140) from continuing downward to activate the piezo unit (30). Accordingly, the above parts can be positioned to prevent the button cover (140) from releasing fuel when the button cover (140) is pressed down.

The lighter (1) can also be equipped with a windscreen (90), which provides wind protection so that a flame is more easily generated and less easily extinguished by wind. Moreover, the windscreen (90) can also hold the top portion of the lighter (1) together by engaging the button cover (140), the button (110), and the top portion of the lighter housing (10). With reference to all of the figures, it is noted that the invention disclosed herein is not to be limited by the embodiment shown in the figures and described in the description, which is provided by way of example and not of limitation, but only in accordance with the scope of the appended claims.

I claim:

1. A lighter having a body having a longitudinal axis, a fuel tank is disposed within the body, a valve for releasing fuel from said fuel tank, a piezo electric unit capable of providing a spark to ignite fuel released from said tank, and a button for activation of said piezo unit and for release of fuel from said valve, the improvement comprising:

said button having a top surface with a first elevation and a second elevation, both of which are substantially perpendicular to said longitudinal axis of said lighter body;

said second elevation extending over said piezo unit;

a button cover having a surface that extends over said second elevation of said button;

said button cover having sides wherein at least one of said sides is capable of engaging a blocking element that prevents said button cover from being depressed a sufficient distance to activate said piezo unit; and, said first elevation of said button capable of being depressed independently of said button cover thereby causing said second elevation to activate said piezo unit and said valve whereby a flame is generated.

2. The lighter of claim 1, further comprising a windscreen.

* * * * *